United States Patent [19]

Esser et al.

[11] 4,248,068

[45] Feb. 3, 1981

[54] DEADLOCKING MECHANISM

[75] Inventors: Hans J. Esser, Keysborough; Gerald F. Dunphy, Glen Waverley, both of Australia

[73] Assignee: Ogden Industries Pty. Limited, Victoria, Australia

[21] Appl. No.: 954,986

[22] Filed: Oct. 26, 1978

[30] Foreign Application Priority Data

Oct. 27, 1977 [AU] Australia ..... PD2214

[51] Int. Cl.[3] ..... E05B 65/06; E05B 11/00

[52] U.S. Cl. ..... 70/134; 70/389; 70/418; 292/142

[58] Field of Search ..... 70/134, 129, 120, 418, 70/389; 292/142, 39

[56] References Cited

U.S. PATENT DOCUMENTS

| | | | |
|---|---|---|---|
| 685,188 | 10/1901 | Taylor | 70/418 |
| 1,330,650 | 2/1920 | Pehel | 70/134 |
| 1,383,128 | 6/1921 | Larsen | 70/134 X |
| 1,714,150 | 5/1929 | Whitehouse | 70/134 X |
| 3,175,376 | 3/1965 | Cantwell | 70/134 X |
| 3,464,242 | 9/1969 | Torii | 70/134 |

FOREIGN PATENT DOCUMENTS

| | | | |
|---|---|---|---|
| 994252 | 11/1951 | France | 70/134 |
| 631343 | 11/1949 | United Kingdom | 70/134 |
| 968635 | 9/1964 | United Kingdom | 70/134 |

*Primary Examiner*—William E. Lyddane

[57] ABSTRACT

Deadlocking mechanism of the kind including a deadbolt slidably located in a casing so as to be projected beyond an end of that casing in an operative position, and to be substantially contained within the casing in an inoperative position. An actuator such as a key operated pin tumbler lock is operable to cause movement of the deadbolt between its two positions. The invention comprises an improved drive connection between the actuator and deadbolt, which includes a toothed pinion rotatable with the actuator and a rack cooperatively engaged by the pinion and arranged for movement with the deadbolt. That drive connection also includes two gear segments which rotate with the pinion and actuator respectively, and have intermeshing engagement during part only of the pinion movement corresponding to movement of the deadbolt between its operative and inoperative positions. As a result of that interrupted engagement, the lock barrel can be turned independent of the deadbolt to a particular position which is the only rotational position of the barrel at which the operable key can be inserted and withdrawn.

6 Claims, 9 Drawing Figures

DEADLOCKING MECHANISM

This invention relates to deadlocking mechanism and is particularly although not exclusively concerned with such mechanism for a tubular cylinder lock construction. It will be convenient to hereinafter describe the invention in relation to that particular example.

Tubular cylinder deadlocks have acquired some popularity because of their convenience of mounting, but they generally suffer a serious security problem. Such deadlocks are usually capable of independent operation from inside and outside the associated door by a knob or handle and a key respectively, although key operation for both sides is sometimes provided. Because of that two sided actuation, it is normal to provide lost motion in the connection between the actuators (e.g., knob or handle and pin tumbler lock barrel) and it is also normal for the pin tumbler lock to be arranged so that the key can be inserted and withdrawn only when the barrel is located in a particular rotational position.

In a typical construction, the lock barrel must be rotated through approximately 120° to move the deadbolt from the fully retracted position to the operative position at which the deadbolt is at maximum exposure. When the deadbolt is at the operative position, a pin or other device is arranged to provide a physical obstruction to movement of the bolt back into the casing, and that pin is moved between its active and inactive conditions by rotation of the lock barrel. It is necessary however, for the barrel to move through substantially its full 120° rotation to place the retainer pin in its active position, but it is not always apparent to a person operating the mechanism whether or not the active position has been reached. By way of example, the operator may prematurely return the barrel to the initial key receiving position out of sheer laziness, or an obstruction or frictional resistance to bolt movement deceives the operator into believing that the operative position has been reached. Because of the aforementioned lost motion connection, that return movement of the barrel does not cause the deadbolt to be withdrawn back into the casing, as that requires reverse movement of the barrel beyond the initial position.

It therefore happens that the deadbolt is only partially projected out of the casing and is susceptible to movement back into the casing by endwise pressure. In that regard, as explained above, the retaining pin does not normally reach its active position until the deadbolt is at its operative position. As a result, it is a relatively simple matter for a person to gain improper entry through a door having such a deadlocking mechanism, if the bolt has not been fully projected through inadvertence or lack of care.

A principal object of the present invention is to provide a deadlocking mechanism of the kind indicated which alleviates or overcomes the foregoing problem. In one particular form, a deadlocking mechanism according to the invention is arranged so that the key cannot be withdrawn until the deadbolt has achieved either a fully projected or fully retracted position, so that proper functioning of the mechanism can be readily detected.

According to one aspect of the present invention, there is provided deadlocking mechanism including; a casing securable to a support; a deadbolt slidably mounted on said casing for relative movement between an operative position in which a head portion thereof projects out of said casing, and an inoperative position in which said head portion is substantially contained within said casing; actuator means mounted on said casing for relative movement towards and away from a lock position; and drive means providing a drive connection between said actuator means and said deadbolt so that said deadbolt is positively driven between said operative and inoperative positions in response to movement of said actuator means, and being arranged to automatically break said drive connection when said actuator means is moved in one direction beyond a disengage position thereof and to automatically re-form said drive connection when said actuator means is moved in a direction opposite to said one direction from beyond said disengage position; said actuator means adopting said lock position when moved in said one direction beyond said disengage position and having no influence on said deadbolt during movement between said lock and disengage positions; said deadbolt being moved towards said operative position by movement of said actuator means in said one direction and being moved towards said inoperative position by movement of said actuator means in said opposite direction, said operative position corresponding to said disengage position of said actuator means.

According to a further aspect of the invention, there is provided a deadbolt assembly including; a tubular casing which is open at one end and has a laterally outwardly extending flange at said open end; a deadbolt slidably mounted within said casing and having a head portion which projects out of said open end in an operative position of said deadbolt and is substantially contained within said casing in an inoperative position thereof; a pinion mounted within said casing for rotational movement about an axis extending transverse to the longitudinal axis of the casing; a drive member mounted within said casing for movement longitudinally thereof, means connecting said drive member to said deadbolt for movement therewith; teeth on said drive member intermeshing with said pinion during movement of said deadbolt between said operative and inoperative positions; and a gear member secured to said pinion for rotation therewith and being exposed through a wall of said casing for cooperative engagement with another gear member.

It is a feature of the mechanism according to a preferred form of the invention that the lock barrel is turned through 360° in transferring the mechanism from an inoperative to an operative position, so that the key can be removed at the end of that movement rather than requiring reverse rotation of the barrel as in prior constructions. It is a feature of the invention in all forms, that the deadbolt will be automatically retracted if the barrel is rotated in the reverse direction back to the initial condition, any time after projection of the deadbolt has commenced.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 7:
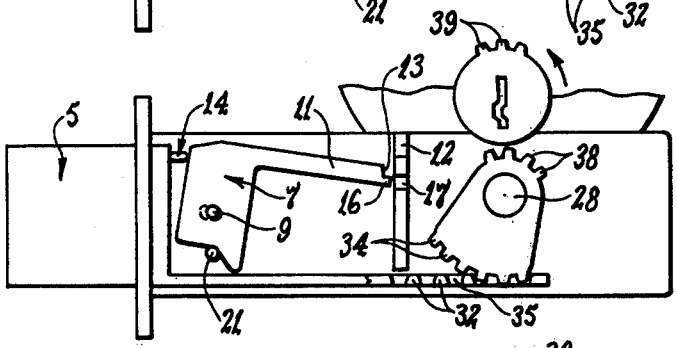
FIG. 7 is a semi-diagrammatic view similar to FIG. 2 but showing the deadbolt in its operative position.

The mechanism casing 2 may be of any convenient form including a cylindrical tube 3 and a lateral flange 4 at a front end of that tube for securing the casing 2 to a door or the like. The deadbolt 5 is slidably mounted in the tube 3 and has a head portion 6, part of which projects beyond the open front end of the tube 3 in the operative condition of the deadbolt 5 (FIG. 7). A forwardly facing shoulder (not shown) may be provided on the head portion 6 to abut part of the casing 2 so as to prevent projection of the deadbolt 5 beyond the operative position as shown in FIG. 7.

Figure 1:
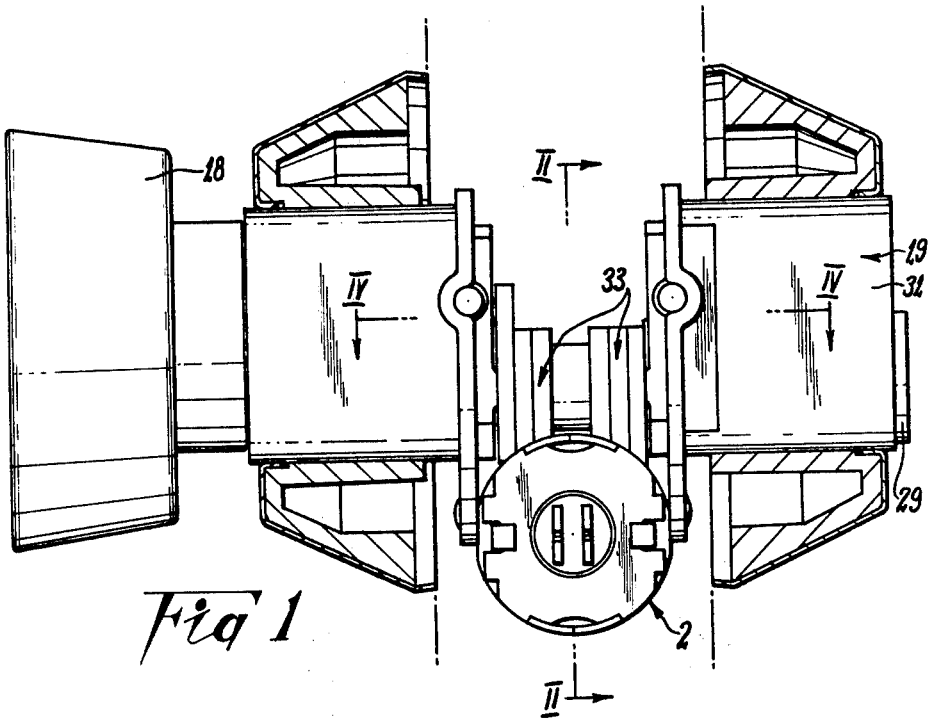
FIG. 1 is a front elevational view of a typical deadbolt assembly to which the invention can be applied.
Figure 2:
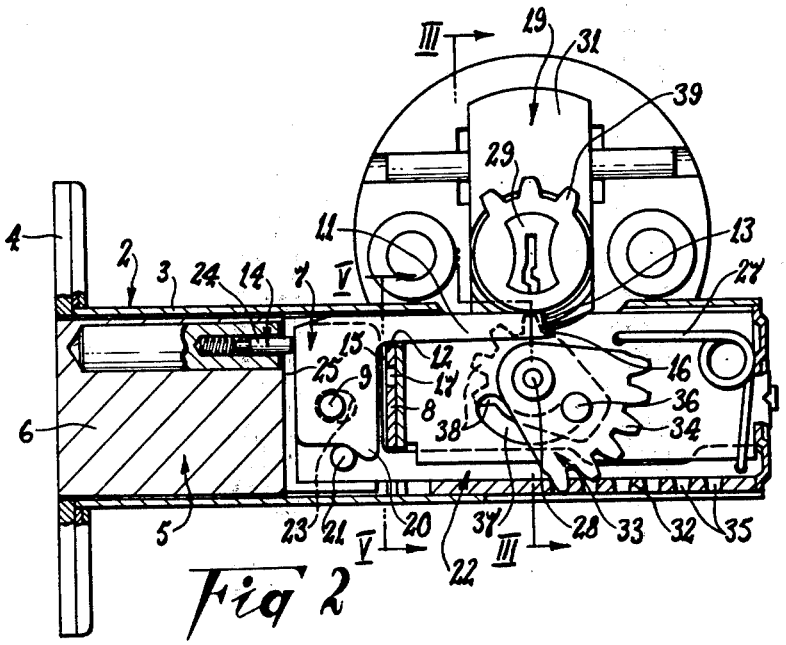
FIG. 2 is an enlarged cross-sectional view taken along line II—II of FIG. 1.
Figure 5:
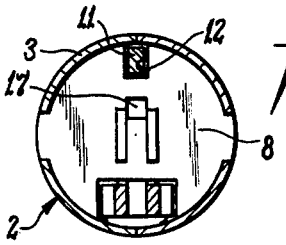
FIG. 5 is a sectional view taken along line V—V of FIG. 2.

Retaining means is provided to releasably hold the deadbolt 5 in its operative position, and in particular to prevent the deadbolt 5 being improperly forced back into the casing 2 by endwise pressure. In the form shown, that retaining means includes a deadlocking lever 7 carried by the deadbolt 5 so as to be movable between locking and release positions (FIGS. 7 and 8 respectively), and a stop plate 8 secured within the casing tube 3 for engagement by the lever 7 when in its locking position (FIG. 7). The lever 7 may be mounted on the deadbolt 5 for limited pivotal movement about a pivot pin 9 extending transverse to the longitudinal axis of the deadbolt 5, and which is arranged adjacent an end 10 of the lever 7. An elongate arm 11 of the lever 7 is arranged to extend through a gate opening 12 (FIG. 5) of the stop plate 8 when the deadbolt 5 is not in its fully projected operative position (FIGS. 2 and 5), and the pivot pin 9 is located to one side of the longitudinal axis of the arm 11 as shown in FIG. 2.

When the deadbolt 5 is moved to its fully projected operative position (FIG. 7), the terminal end 13 of the lever arm 11 is located forwardly of the stop plate 8. Biasing means 14 is preferably provided to urge the lever 7 about its pivot 9 so that in the operative position of the deadbolt 5, the lever 7 is caused to pivot and adopt its locking position at which the terminal end 13 is not aligned with the gate opening 12, but is adapted to abut an adjacent surface 15 of the stop plate 8. If desired, a slight projection 16 may be provided at the terminal end 13 to engage in an aperture 17 of the stop plate 8 in the event that an attempt is made to force the deadbolt 5 back into the casing 2. Such an arrangement guards against the possibility of the arm 11 being forced to ride across the plate surface 15 so as to be aligned with the gate opening 12.

Figure 3:
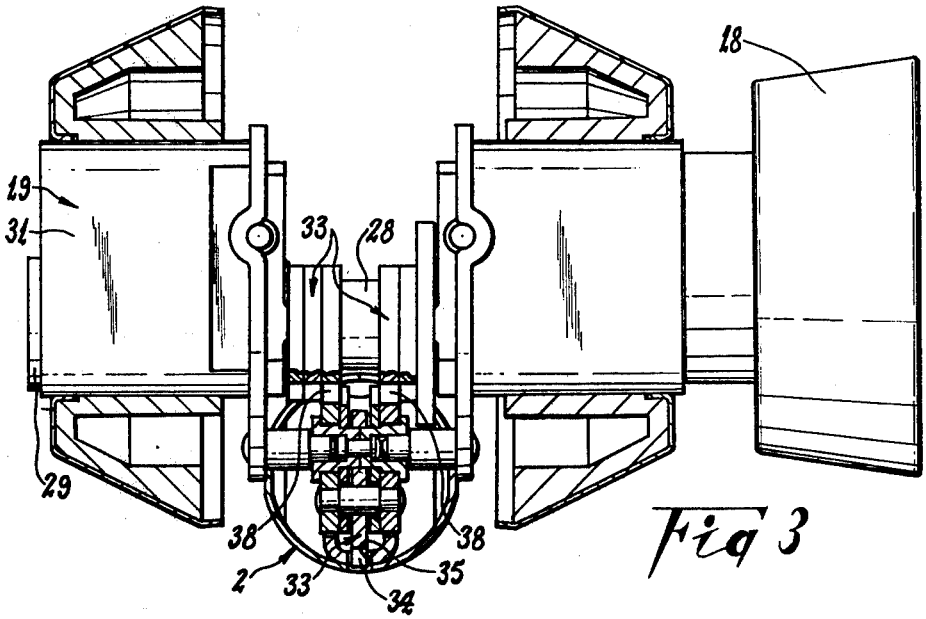
FIG. 3 is a partial cross-sectional view taken along line III—III of FIG. 2.

In the preferred construction shown, pivotal movement of the deadlocking lever 7 back from the locking position, is controlled by cam means which is responsive to the actuator—i.e., knob 18 (or handle) or pin tumbler lock 19 (FIG. 3). That cam means may include a lobe 20 as shown attached to or forming part of the lever 7, and a striker 21 attached to or forming part of a member 22 included in the connection between the deadbolt 5 and the actuator 18, 19. The lobe 20 and lever arm 11 are located on opposite sides respectively of the lever pivot 9, and the lobe 20 is located rearwardly of the striker 21 relative to the open or front end of the casing 2.

Figure 6:
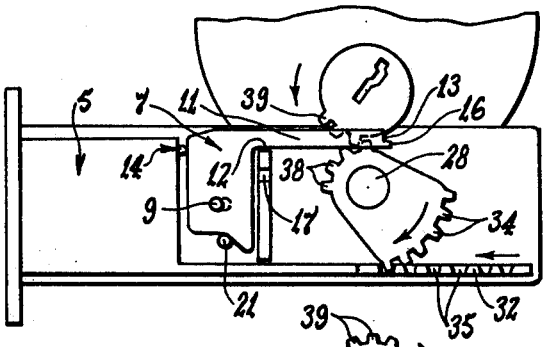
FIG. 6 is a view of the drive mechanism as shown in FIG. 2, but in an advanced position towards moving the deadbolt towards its operative position.

Lost motion means may be provided in the connection between the actuator 18, 19 and the deadbolt 5, so that when the deadbolt 5 is in its operative position (FIG. 6), the actuator 18, 19 can function (to a limited extent) independent of the deadbolt 5 to return the deadlocking lever 7 from its locking position (FIG. 7). Such lost motion may be achieved as shown by the attachment between the connector member 22 and the deadbolt 5, which attachment includes the pin 9 passing through a slot 23 formed in the connector member 22 (FIG. 2). The slot 23 extends in the direction of movement of the deadbolt 5 so that relative movement between the deadbolt 5 and connector member 22 is limited by the length of the slot 23. As shown, the same pin 9 is used to provide both the pivot axis for the deadlocking lever 7 and the connection between the deadbolt 5 and the member 22, but that is not essential as different pins can be used for each of those purposes.

The foregoing arrangement is such that when the deadbolt 5 is moved into the operative position, the pivot pin 9 is located at the rearward end of the connector slot 23, and the terminal end 13 of the lever 11 is positioned forwardly of the stop plate 8. At that position, the biasing means 14, which in the construction shown includes a spring influenced pin 24 projecting from a rearward face 25 of the deadbolt 5, causes the lever 7 to swing about its pivot 9 into the locking position (FIG. 7). If endwise pressure is then applied to the deadbolt 5 in the direction shown by the arrow 26 in FIG. 8, the deadlocking lever 7 will move with the deadbolt 5 because of the connection through pivot pin 9 and is thereby moved into engagement with the stop plate 8. The degree of movement available before that engagement occurs, may be quite small. Under the foregoing circumstances, the connector member 22 also moves with the deadbolt 5 so that the relative positions of the cam components 20 and 21 do not change, and the cam means is therefore inoperative.

Figure 8:
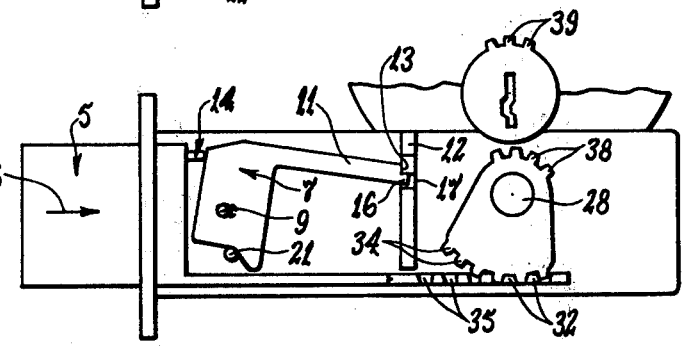
FIG. 8 is a view similar to FIG. 7 but showing the result of endwise pressure on the deadbolt.
Figure 9:
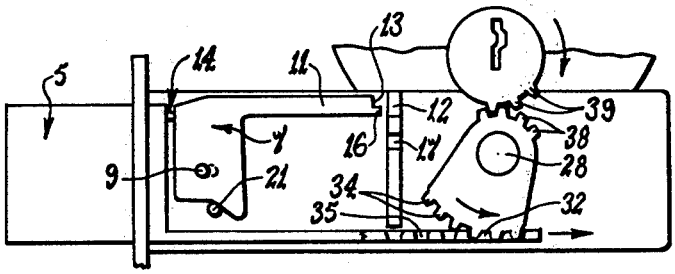
FIG. 9 is a view similar to FIG. 6 but showing the mechanism being operated to return the deadbolt to its inoperative position.

Spring 27 (FIG. 2) serves to hold the connector 22 and deadbolt 5 in the outermost position as shown in FIG. 7, in the absence of endwise pressure as discussed in relation to FIG. 8. If the actuator 18, 19 is operated while the deadbolt 5 is in the operative position as shown in FIG. 7, the initial response to that operation will be rearward movement of the connector member 22 relative to both the deadbolt 5 and the deadlocking lever 7. That rearward movement is possible because of the forward clearance provided between the connector slot 23 and the pivot pin 9. Such relative movement brings the cam striker 21 against the cam lobe 20, so that as the movement continues the lever 7 is progressively swung about its pivot 9 against the influence of the biasing means 14, and the lever arm 11 is placed into alignment with the gate opening 12 before or at the time of engagement between the pivot pin 9 and the forward end of the slot 23 (FIG. 9). After that engagement, the deadbolt 5 and lever 7 are caused to respond to the actuator 18, 19 so as to be drawn back into the casing 2.

Movement of the deadbolt 5 between its operative and inoperative positions is effected by means of a positive drive connection between the actuator spindle 28 (FIG. 3) and the deadbolt 5, which connection is automatically engaged during a predetermined part of each 360° rotation of the actuator spindle 28, and is automatically disengaged during the remainder of that rotation. The engaged section of that rotation has its extremities at the operative and inoperative positions respectively of the deadbolt 5, which correspond to the positions shown in FIGS. 7 and 2 respectively. In the construction shown, a key operated pin tumbler lock 19 is used to cause rotation of the actuator spindle 28 from one end, and the lock 19 is preferably arranged so that the key (not shown) can be withdrawn and inserted at one rotational position only of the lock barrel 29 relative to the cylinder 31 (FIG. 2), and that position is within the disengaged section of the spindle rotation—preferably at or adjacent the mid point of that section—which is the position shown in FIG. 2.

It is to be appreciated that the actuator spindle 28 may not be a spindle as such, but can be any rotatable member through which the actuator or actuators can function. For example, it may be an extension of a cylinder lock barrel, or a stub-shaft of a knob or handle, or it may be a bar or any other member extending between a knob or handle and a lock barrel.

In the preferred construction shown, the aforementioned drive connection includes a rack and pinion arrangement, the rack may be of any convenient form, but in the arrangement shown it is an apertured plate 32 secured to or forming an integral part of the connector member 22 and is located rearward of the cam means 20, 21 (FIG. 2). The cooperative pinion 33 is rotatably mounted on the casing 2 and has a gear segment 34 of predetermined length arranged to drivably engage within the apertures 35 of the rack plate 32, with the result that longitudinal movement of the connector member 22 occurs if such engagement exists and the pinion 33 is rotated. That of course results in corresponding movement of the deadbolt 5, subject to the aforementioned lost motion. The arrangement is such that engagement of the rack and pinion 32 and 33 exists during movement of the deadbolt 5 between its operative and inoperative positions, and it may be terminated beyond each of those positions, but that is generally not preferred. In the preferred arrangement, a pin 36 secured to the pinion 33 tracks in a slot 37 of the casing 2, and limits the travel of the pinion 33 by engagement with the ends of the slot 37 (FIG. 2).

The pinion 33 as shown includes a second gear segment 38 which is ideally located in diametrically opposed relationship to the rack engaging segment 34 of the pinion 33, and which preferably has a pitch diameter smaller than that of the rack engaging segment 34 (FIG. 2). The second segment 38 is drivably engageable with a spur gear segment 39 which may be secured to or form part of the actuator spindle 28, but which at least rotates in response to rotation of that spindle. The spur gear segment 34 and the pinion gear segment 38 preferably engage only during movement of the deadbolt 5 between its operative and inoperative positions (FIGS. 7 and 2), and that may be achieved as shown by having the spur gear segment 39 of a length such that it automatically looses engagement with the pinion gear segment 38 when its rotational position passes beyond that corresponding to either extreme position of the deadbolt 5. It is further preferred that the lock barrel 29 is arranged so that the key (not shown) can be withdrawn or inserted only when the rotational position of the spur gear 39 is mid-way between the two positions in its 360° range of movement at which engagement with the pinion gear 33 is maintained—i.e., the position shown in FIG. 2.

Quite obviously the aforementioned construction can be modified in various ways whilst still adhering to the basic concept. For example, the rack engaging pinion 33 may be a full diameter gear, and the same may apply to either the spur gear 39 or the second pinion gear segment 38. It is generally necessary however, that one of the two gears 38 and 39 has a toothed segment of predetermined length only so as to enable the automatic engagement and disengagement as described, subject only to that engagement and disengagement being achieved by movement of the pinion 33 into and out of engagement with the rack 32. The last mentioned alternative can be achieved by maintaining continual engagement between the spur gear 39 and pinion 33, but limiting the toothed segment 34 of the pinion 33 which engages with the rack 32.

Figure 4:
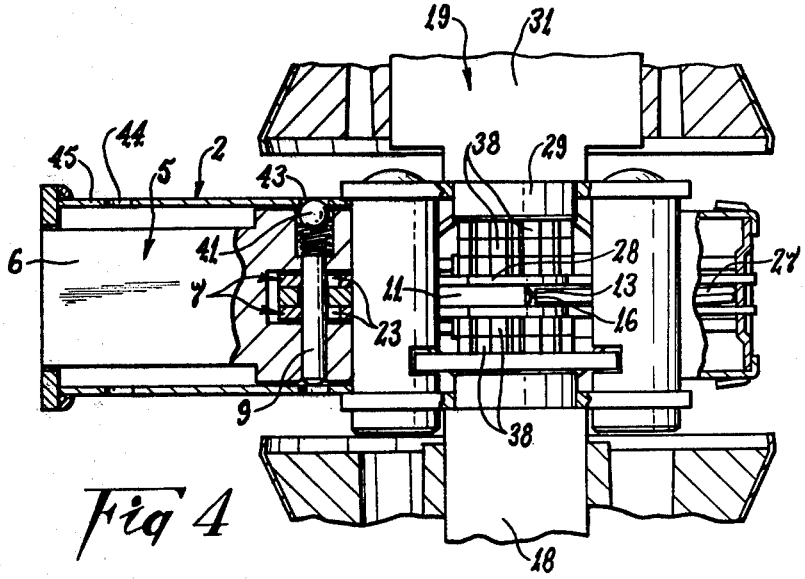
FIG. 4 is a sectional view taken along line IV—IV of FIG. 1.

Detent means may be provided to releasably hold the deadbolt 5 in each of its two extreme positions. In the example shown in FIG. 4, that comprises a spring influenced detent ball 41 carried by the deadbolt 5 so as to be adapted to project beyond a side surface 42 of that bolt. Two cooperative detent holes 43 and 44 or recesses are provided in a wall 45 of the casing 2 at spaced locations which respectively correspond to the location of the detent ball 41 at a particular extreme position of the deadbolt 5. Thus, at the deadbolt operative position of FIG. 7, the detent ball 41 locates in the forwardmost hole 44 so as to firmly hold the deadbolt 5 at that position and thereby hold the deadlocking lever arm 11 clear of the stop plate 8. Furthermore, as the deadbolt 5 approaches each of its extreme positions, location of the detent ball 41 into the respective hole 43 or 44 enables the operator to "feel" when the desired bolt position has been reached.

A mechanism as described has substantial advantages over the prior art constructions in that it ensures that the deadbolt is returned fully to the inoperative position in the event that the associated actuator is rotated in a reverse direction to its initial position at any time that the spur end pinion gears engage. As explained, such engagement occurs whenever the deadbolt is located between its operative and inoperative positions and consequently a condition of high security is achieved.

Finally, it is to be understood that various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. Deadlocking mechanism including; a tubular casing securable to a support; a deadbolt slidably mounted within said casing for relative movement between an operative position in which a head portion thereof projects out of said casing, and an inoperative position in which said head portion is substantially contained within said casing; actuator means mounted on said casing and including a lock barrel which is located externally of said casing and is rotatable relative thereto towards and away from a lock position; a gear segment connected directly to said lock barrel for rotation therewith; a rack and pinion assembly located within said casing; said rack being movable lengthwise of said casing in response to rotation of said pinion, means connecting said rack to said deadbolt for movement therewith; lost motion means forming part of said connecting means and permitting limited relative movement between said rack and said deadbolt; a deadlocking member located within said casing and being operative to releasably hold said deadbolt in said operative position; said deadlocking member being responsive to said limited relative movement between said rack and deadbolt to release said deadbolt for movement into said inoperative position, and a gear segment connected to said pinion within said casing for rotation with said pinion and being engagable with said barrel gear segment through an opening in wall of said casing to form a drive connection whereby said deadbolt is moved between said operative and inoperative positions in response to rotation of said barrel; said two gear segments being relatively arranged so that said drive connection is automatically broken when said barrel is rotated in one direction beyond a disengage position thereof and is automatically reformed when said barrel is rotated in an opposite direction from beyond said disengage position; said barrel adopting said lock position when rotated in said one direction beyond said disengage position and having no influence on said deadbolt during rotation between said lock and disengage positions; said deadbolt being moved towards said operative position by rotation of said barrel in said one direction and being moved towards said inoperative position by rotation of said barrel in said opposite direction, said operative position corresponding to said disengage position of said barrel.

2. Deadlocking mechanism according to claim 1, wherein said actuator means includes a key operated pin tumbler cylinder lock and said rotatable barrel forms part of said lock, said lock being arranged so that the key therefor can be inserted into and removed from the barrel only when said barrel is in said lock position, and said barrel is arranged to be rotated from said lock position in said one direction to cause movement of said deadbolt into the operative position, and to be rotated from said lock position in said opposite direction to cause movement of the deadbolt into the inoperative position, whereby said barrel is turned through 360° in any one complete operation of said actuator means.

3. Deadlocking mechanism according to claim 2, wherein said lock position of the barrel is substantially mid-way between the positions thereof which correspond to the operative and inoperative positions of the deadbolt.

4. Deadlocking mechanism according to claim 1, wherein said casing comprises a cylindrical tube which is open at one end and has a laterally outwardly extending flange provided at said open end, said deadbolt is slidably mounted within said tube for movement through said open end.

5. A deadbolt assembly including; a tubular casing which is open at one end and has a laterally outwardly extending flange at said open end; a deadbolt slidably mounted within said casing and having a head portion which projects out of said open end in an operative position of said deadbolt and is substantially contained within said casing in an inoperative position thereof; a pinion mounted within said casing for rotational movement about an axis extending transverse to the longitudinal axis of the casing; a drive member mounted within said casing for movement longitudinally thereof; teeth on said drive member intermeshing with said pinion during movement of said deadbolt between said operative and inoperative positions; means connecting said drive member to said deadbolt for movement therewith; lost motion means forming part of said connecting means and permitting limited relative movement between said drive member and said deadbolt, a deadlocking lever pivotally mounted within said casing for movement between a deadlocking position at which it holds said deadbolt in said operative position and a release position at which it allows said deadbolt to travel to said inoperative positions; said deadlocking lever being responsive to said limited relative movement between said drive member and said deadbolt to move between said deadlocking and release positions; and a gear member secured to said pinion and being exposed through a wall of said casing for cooperative engagement with another gear member.

6. A deadbolt assembly according to claim 5, wherein detent means is provided to releasably hold said deadbolt in both said operative and inoperative positions thereof, said detent means comprising a spring loaded ball detent carried by said deadbolt and adapted to project beyond a surface thereof, and two recesses in said casing; each of which is engaged by said ball in a respective one of said deadbolt positions.

* * * * *